United States Patent [19]

Oliff et al.

[11] 4,172,546

[45] Oct. 30, 1979

[54] ARTICLE CARRIER PARTITION INSERT

[75] Inventors: James R. Oliff, Austell; Will L. Culpepper, Tucker, both of Ga.

[73] Assignee: The Mead Corporation, Dayton, Ohio

[21] Appl. No.: 19,295

[22] Filed: Mar. 9, 1979

[51] Int. Cl.[2] ..... B65D 75/52; B65D 5/48

[52] U.S. Cl. ..... 229/42; 229/28 BC; 206/427

[58] Field of Search ..... 229/42, 15, 28 BC; 206/175, 427

[56] References Cited

U.S. PATENT DOCUMENTS

| | | | |
|---|---|---|---|
| 2,919,815 | 1/1960 | Mairs et al. | 229/42 X |
| 3,070,276 | 12/1962 | Richardson | 229/28 BC X |
| 3,194,478 | 7/1965 | Weiss | 229/42 |
| 3,211,357 | 10/1965 | Weiss | 229/42 |
| 3,384,289 | 5/1968 | Grant | 229/42 X |
| 4,007,830 | 2/1977 | Calvert | 229/28 BC X |
| 4,084,693 | 4/1978 | Culpepper | 206/427 |

*Primary Examiner*—Davis T. Moorhead

*Attorney, Agent, or Firm*—Walter M. Rodgers; Walter A. Rodgers

[57] ABSTRACT

An article carrier used in the packaging of at least two rows of articles of at least two articles each is provided with a partition insert comprising a spacer panel (42), main panels (41,44) foldably joined to the side edges of the spacer panel, a pair of partition tabs (46,51,56,61) foldably joined to each main panel and extending outwardly therefrom, a pair of auxiliary partition tabs (49,54,59,64) foldably joined to each main panel along fold lines (50,55,60, 65) offset from the base of the corresponding partition tab and disposed in overlapping relationship therewith, a pair of connecting elements (70,71) secured to one of the main panels and with the ends thereof disposed in abutting relationship with the other of the main panels, and a partition panel (80) secured to the outer ends of the connecting elements.

11 Claims, 4 Drawing Figures

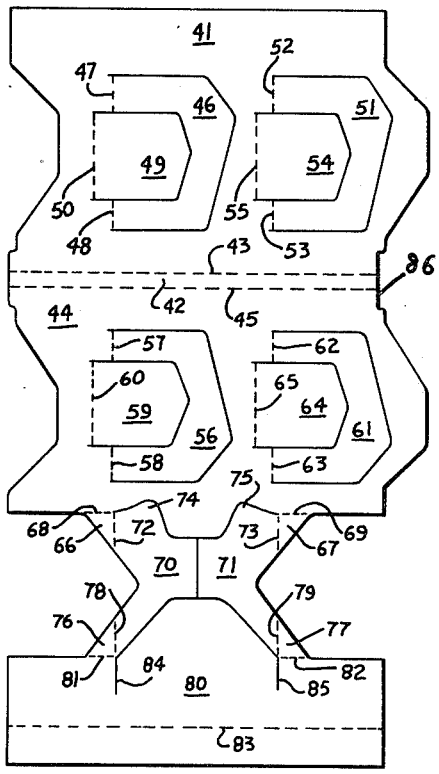

ARTICLE CARRIER PARTITION INSERT

TECHNICAL FIELD

This invention relates to an insert used in the packaging of fragile articles such as bottles which is held firmly in place and which has a double thickness of paperboard between all points of article contact.

BACKGROUND ART

Inserts which are used in the packaging of fragile articles are generally known as evidenced by U.S. Pat. No. 4,007,830, owned by the assignee of this invention. Often this general type of insert tends to move out of the proper orientation relative to the bottles as the carrier is formed and subsequent thereto when the carrier is transported. Of course this causes the possibility of undesirable article contact. In addition certain known inserts require the utilization of an inordinately large amount of paperboard material in order to achieve the desired double thickness between articles.

DISCLOSURE OF INVENTION

According to this invention, an article carrier partition insert is provided and comprises a spacer panel with a pair of main panels upstanding therefrom, at least one partition tab foldably joined to each main panel and extending outwardly therefrom, and at least one auxiliary partition tab joined to each main panel along a fold line offset from the base of the corresponding partition tab and disposed in overlapping relation therewith.

BEST MODE FOR CARRYING OUT THE INVENTION

Figure 1:
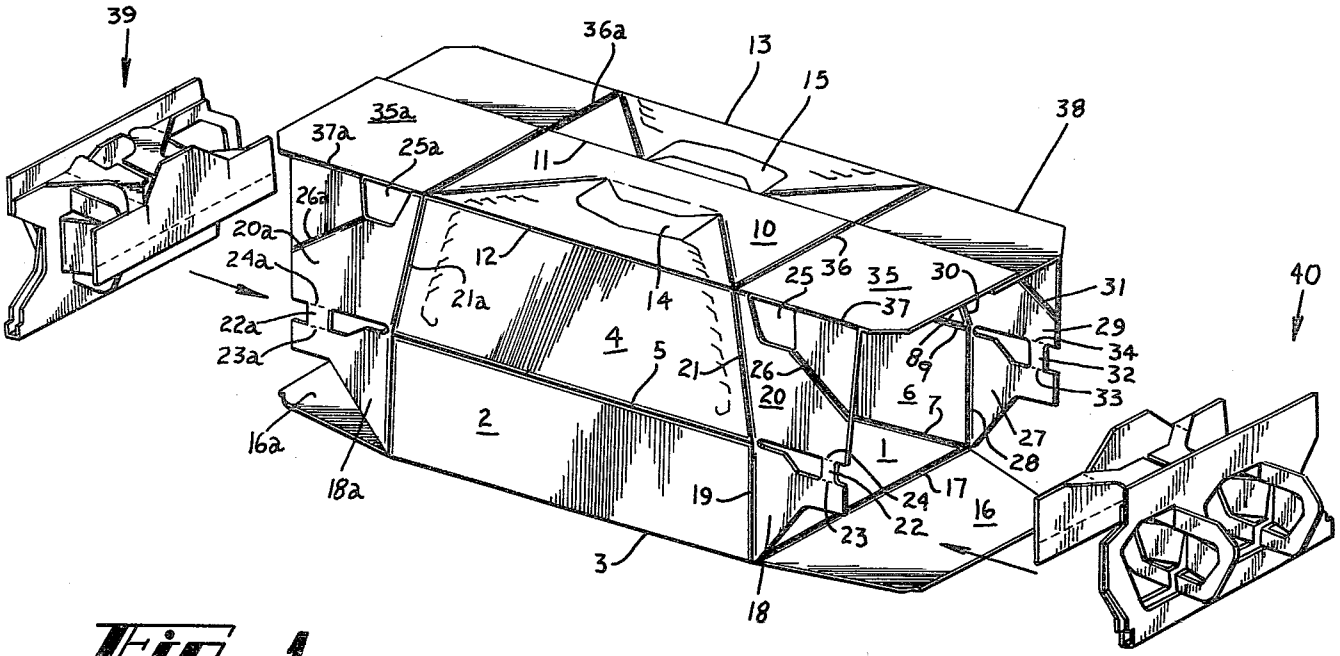
FIG. 1 is a perspective exploded view of an open ended sleeve type carrier together with a pair of inserts constructed according to this invention and which are adapted for insertion with their associated articles through opposite ends of the carrier.

In FIG. 1 the open ended sleeve type carrier comprises a bottom panel 1, a lower side wall panel 2 which is foldably joined to the side edge of bottom panel 1 along fold line 3 together with a sloping upper side wall panel 4 which is foldably joined to the lower side wall panel 2 along fold line 5. The other side of the carrier is similar in that a lower side wall panel 6 is foldably joined along fold line 7 to a side edge of bottom panel 1 and a sloping upper side wall panel 8 is foldably joined to lower side wall portion 6 along fold line 9. Top wall panel 10 is a composite panel and is overlapped at its midportion 11. Top panel 10 is foldably joined along fold line 12 to panel 4 and along fold line 13 to panel 8. A pair of hand gripping apertures 14 and 15 are formed in known manner in top panel 10.

The end flaps at the ends of the carrier are identical and the flaps at only one end will be described, the flaps at the other end having the same numerals with the subscript "a" added. For example, bottom end panel 16 is foldably joined along fold line 17 to an end edge of bottom panel 1. Lower end flap 18 is foldably joined to panel 2 along fold line 19 while upper end flap 20 is foldably joined to panel 4 along fold line 21. Web panel 22 is foldably joined to panel 18 along fold line 23 and to panel 20 along fold line 24. Panel 20 is provided with an aperture 25 for receiving a part of the cap of the adjacent article, such as a bottle, and includes a diagonal fold line 26.

On the opposite side of the carton, lower end flap 27 is foldably joined to side wall 6 along fold line 28 while upper end flap 29 is foldably joined to panel 8 along fold line 20 and includes diagonal fold line 31. Web panel 32 is foldably joined to lower end flap 27 along fold line 33 and to upper end flap 29 along fold line 34. Upper end panel 35 is a composite panel and is foldably joined to top wall 10 along fold line 36 and to panels 20 and 29 along fold lines 37 and 38 respectively.

As is apparent from FIG. 1 a pair of inserts designated generally by the numerals 39 and 40 are arranged for insertion through opposite ends of the open ended sleeve shown in FIG. 1. Inserts 39 and 40 are of identical construction although they are oppositely oriented. Adjacent panels of the inserts are disposed in contacting relation so as to afford a double thickness of material between articles disposed in one insert and the adjacent articles disposed in the other insert.

Figure 2:
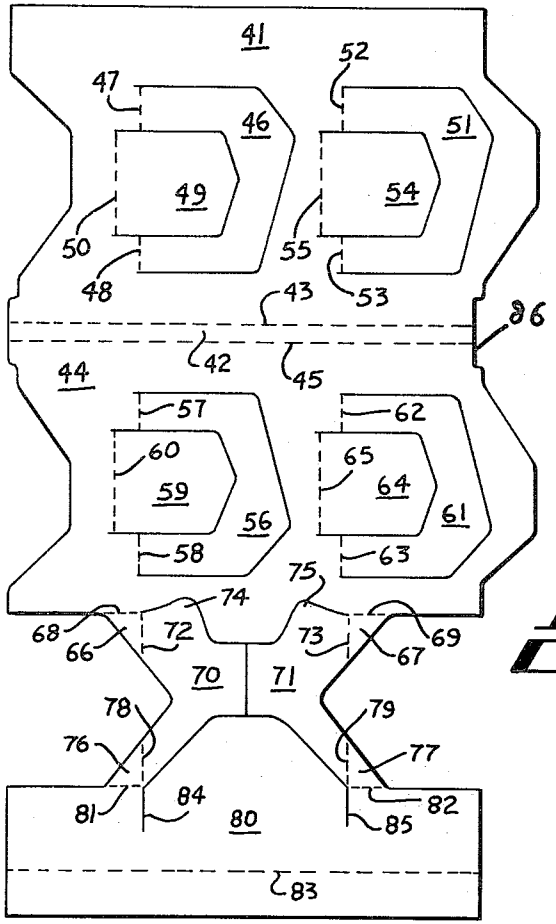
FIG. 2 is a plan view of a blank used in forming the two partition inserts shown in FIG. 1.

Inserts 39 and 40 are formed from the blank shown in FIG. 2 which comprises a main panel 41 which is interconnected along its bottom edge to spacer panel 42 along fold line 43. Main panel 44 is interconnected with spacer panel 42 along fold line 45.

Partition tab 46 is struck from main panel 41 and is foldably joined thereto along separated fold lines 47 and 48. Auxiliary partition tab 49 is struck in part from partition tab 46 and is foldably joined to main panel 41 along fold line 50. Similarly partition tab 51 is struck from main panel 41 and is foldably joined thereto along fold lines 52 and 53. Auxiliary partition tab 54 is struck in part from partition tab 51 and is foldably joined to main panel 41 along fold line 55.

Partition tab 56 is similar to partition tab 46 and is struck from main panel 44. Partition tab 56 is foldably joined to main panel 44 along fold lines 57 and 58. Also auxiliary partition tab 59 is struck in part from partition tab 56 and is foldably joined to main panel 44 along fold line 60. Partition tab 61 is also struck from main panel 44 and is foldably joined thereto along separated fold lines 62 and 63 and auxiliary partition tab 64 is struck in part from partition tab 61 and is foldably joined to main panel 44 along fold line 65. Since all the partition tabs and auxiliary partition tabs are formed on the interior of the blank rather than the outer edge, a saving of material is effected.

To complete the basic elements of the blank of FIG. 2, connecting tabs 66 and 67 are foldably joined respectively to main panel 44 along fold lines 68 and 69. Connecting tabs 66 and 67 are joined respectively to connecting elements 70 and 71 along fold lines 72 and 73. In addition connecting elements 70 and 71 are provided with positioning tabs 74 and 75. Connecting tabs 76 and 77 are joined respectively to connecting elements 70 and 71 along fold lines 78 and 79 and to partition panel 80 along fold lines 81 and 82. Also partition panel 80 is provided with bend line 83 and expansion lines 84 and 85. Finally in order to prevent the blank from slipping off the associated machine lugs during formation of the insert, machine manipulation notch 86 is formed adjacent one end of spacer panel 42.

In order to manipulate the blank of FIG. 2 into set-up condition as represented by inserts 39 and 40 in FIG. 1, it is simply necessary to elevate main panel 44, partition panel 80, and all the parts interconnected therebetween upwardly along fold line 45. Following this main panel 41 is elevated along fold line 43 whereby the upper portion thereof forms an abutting relationship with the upper portion of main panel 44. Partition panel 80 and connecting elements 70 and 71 are then lowered along fold lines 68 and 69. Finally partition panel 80 is folded downwardly along fold lines 81 and 82. The insert then appears as shown in FIG. 1.

Prior to insertion of the articles auxiliary partition tabs 49, 54, 59, and 64 are folded outwardly of the blank respectively along fold lines 50, 55, 60, and 65. Thereafter partition tabs 46, 51, 56, and 61 are folded outwardly of the blank along their respective pairs of fold lines 47 and 48, 52 and 53, 57 and 58, and 62 and 63. Since the fold lines associated with each of the auxiliary partition tabs is offset from the base of the corresponding partition tab as represented by the pairs of fold lines associated with each partition tab, as best shown in FIG. 2, each auxiliary partition tab assumes an overlapping relationship with the corresponding partition tab after each is folded into position. Therefore a double thickness of paperboard material is provided for the purpose of cushioning adjacent articles.

Figure 3:
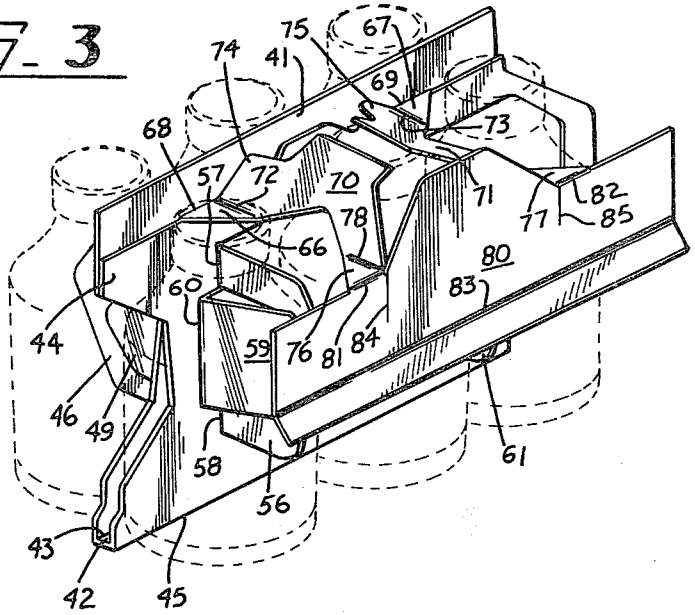
FIG. 3 is a perspective view of a set-up insert constructed according to this invention with the disposition of the bottles shown by dotted lines.
Figure 4:
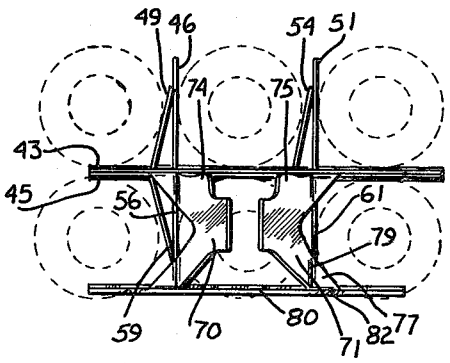
FIG. 4 is a top plan view of an insert as shown in FIG. 3.

With the two inserts in set-up condition as described, the inserts are then lowered from above downwardly over the necks of the associated bottles. As this occurs connecting elements 70 and 71 are forced upwardly by the relative upward movement of the associated medially disposed bottle cap to occupy the positions shown in FIGS. 3 and 4. At the same time, positioning tabs 74 and 75 assume an abutting relationship with the upper portion of main panel 41 which extends beyond the upper edge of main panel 44. Since partition panel 80 is directly connected to connecting elements 70 and 71, any tendency to ride up is thereby prevented.

An additional feature of this invention is provided whereby the distance between main panel 44 and partition element 80 prior to being lowered about the articles is less than the diameter of the corresponding articles. Therefore as the insert is lowered into the cushioning position, expansion lines 84 and 85 allow partition panel 80 to give somewhat and the insert in turn is held tightly around the articles. When the insert is in position, the lower portion of partition panel 80 is allowed to conform to the contour of the article shoulders by means of bend line 83.

Therefore six bottles are disposed in rectilinear relation at each end of the carrier and after the inserts are lowered into position, the inserts and their associated bottles are loaded through opposite ends of the open ended sleeve shown in FIG. 1. This loading operation causes the partition panels 80 to move in face contacting relation with each other.

According to another feature of this invention, in the erected insert the upper portions of main panels 41 and 44 are disposed in face contacting relation and the lower portions are separated by means of spacer panel 42. Therefore the insert assumes a wedge shaped conformation in cross section. This aids in prohibiting the insert from sliding upwardly between the articles disposed on either side thereof during the packaging operation and subsequent shipment and handling.

INDUSTRIAL APPLICABILITY

By this invention an improved insert is provided which has a double thickness of paperboard material between adjacent articles and is held firmly in place as the package is formed and handled.

We claim:

1. An article carrier partition insert for cushioning articles arranged in two rows of at least two articles each, said insert comprising a spacer panel (42), a pair of main panels (41,44) foldably joined respectively to the side edges of said spacer panel and converging therefrom, a partition tab (46,51,56,61) joined to each of said main panels along a first substantially vertical fold line, and characterized in that an auxiliary partition tab (49,54,59,64) is foldably joined to each of said main panels along a second fold line offset from the corresponding one of said first fold lines.

2. An insert according to claim 1 and further characterized in that each of said auxiliary partition tabs is struck at least in part from the corresponding one of said partition tabs.

3. An insert according to claim 1 and further characterized in that each of said auxiliary partition tabs is disposed respectively in overlapping relation with the corresponding one of said partition tabs.

4. An insert according to claim 1 and further characterized in that a connecting element (70,71) is secured to the upper edge of one of said main panels and extends generally outwardly therefrom.

5. An insert according to claim 4 and further characterized in that a partition panel (80) is secured to said connecting elements remote from said one main panel.

6. An insert according to claim 1 and further characterized in that each of said second fold lines is disposed on the side of the corresponding one of said first fold lines opposite from the portion of the associated main panel from which the corresponding one of said partition tabs is struck.

7. An insert according to claim 5 and further characterized in that a bend line (83) is formed in said partition panel and disposed parallel to the lower edge thereof.

8. An insert according to claim 1 and further characterized in that a machine manipulation notch (86) is formed on the edge of said insert adjacent one end of said spacer panel.

9. An article carrier partition insert for cushioning articles arranged in two rows of at least two articles each, said insert comprising a pair of main panels (41,44) secured along the lower edges thereof and disposed in generally vertical positions, the upper edge of one of said main panels extending beyond the upper edge of the other of said main panels, and characterized in that a pair of connecting elements (70,71) are secured respectively to the other of said main panels, a pair of positioning tabs (74,75) are formed respectively on the inner ends of said connecting elements and disposed in abutting relationship with the portion of said one main panel which extends beyond said other main panel, and a partition panel (80) is secured to the outer edges of said connecting elements.

10. An insert according to claim 9 and further characterized in that a pair of partition tabs (46,51,56,61) are foldably joined to said main panels and extend outwardly therefrom.

11. An insert according to claim 9 and further characterized in that the distance between said other main panel and said partition panel is less than the diameter of the articles to be packaged.

* * * * *